US007530344B2

(12) United States Patent
Weiss et al.

(10) Patent No.: US 7,530,344 B2
(45) Date of Patent: May 12, 2009

(54) METHOD FOR CONTROLLING AN INTERNAL COMBUSTION ENGINE IN THE NEUTRAL POSITION

(75) Inventors: Frank Weiss, Pentling/Grasslfing (DE); Hong Zhang, Tegemheim (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/662,675

(22) PCT Filed: Aug. 5, 2005

(86) PCT No.: PCT/EP2005/053869

§ 371 (c)(1),
(2), (4) Date: Mar. 13, 2007

(87) PCT Pub. No.: WO2006/029945

PCT Pub. Date: Mar. 23, 2006

(65) Prior Publication Data

US 2008/0115763 A1 May 22, 2008

(30) Foreign Application Priority Data

Sep. 15, 2004 (DE) ..... 10 2004 044 652

(51) Int. Cl.
*F02D 41/16* (2006.01)

(52) U.S. Cl. ..... 123/339.19

(58) Field of Classification Search ..... 123/339.1, 123/339.12, 339.19, 339.2, 339.21; 73/114.22, 73/114.25, 114.36; 701/110
See application file for complete search history.

(56) References Cited

U.S. PATENT DOCUMENTS

| | | | | |
|---|---|---|---|---|
| 5,253,623 | A * | 10/1993 | Melnyk et al. | 123/339.11 |
| 5,429,089 | A | 7/1995 | Thornberg et al. | |
| 5,484,351 | A * | 1/1996 | Zhang et al. | 477/113 |
| 5,662,085 | A | 9/1997 | Aubourg et al. | |
| 6,199,004 | B1 * | 3/2001 | Russell et al. | 701/54 |
| 6,266,597 | B1 * | 7/2001 | Russell et al. | 701/54 |
| 6,430,492 | B2 * | 8/2002 | Kotwicki et al. | 701/54 |
| 6,497,212 | B2 * | 12/2002 | Matsumoto et al. | 123/295 |
| 6,560,523 | B2 * | 5/2003 | Kotwicki et al. | 701/54 |
| 6,742,498 | B2 * | 6/2004 | Mabuchi et al. | 123/339.16 |
| 6,754,573 | B2 * | 6/2004 | Russell et al. | 701/54 |
| 2004/0074473 | A1 | 4/2004 | Okubo et al. | |

FOREIGN PATENT DOCUMENTS

| | | | |
|---|---|---|---|
| DE | 195 34 844 | A1 | 3/1997 |
| EP | 0 875 673 | A2 | 11/1998 |
| EP | 1 245 809 | A2 | 10/2002 |

* cited by examiner

*Primary Examiner*—Hai H Huynh
(74) *Attorney, Agent, or Firm*—King & Spalding LLP

(57) ABSTRACT

The invention relates to a method for controlling an internal combustion engine in the neutral position, comprising the following steps: the actual idle rotational speed is measured, the actual idle rotational speed is compared to a desired idle rotational speed, correction torque is determined according to the actual idle rotational speed gradients when the actual idle rotational speed deviates from the desired idle rotational speed by more than a predefined value, the correction torque is added to the actual motor torque demand of the internal combustion engine. The advantage of said invention is that the control of the idle rotational speed also takes into account the actual idle rotational speed gradients and the correction torque is added directly to the motor torque demand such that, overall, a very rapid control characteristic is obtained.

11 Claims, 1 Drawing Sheet

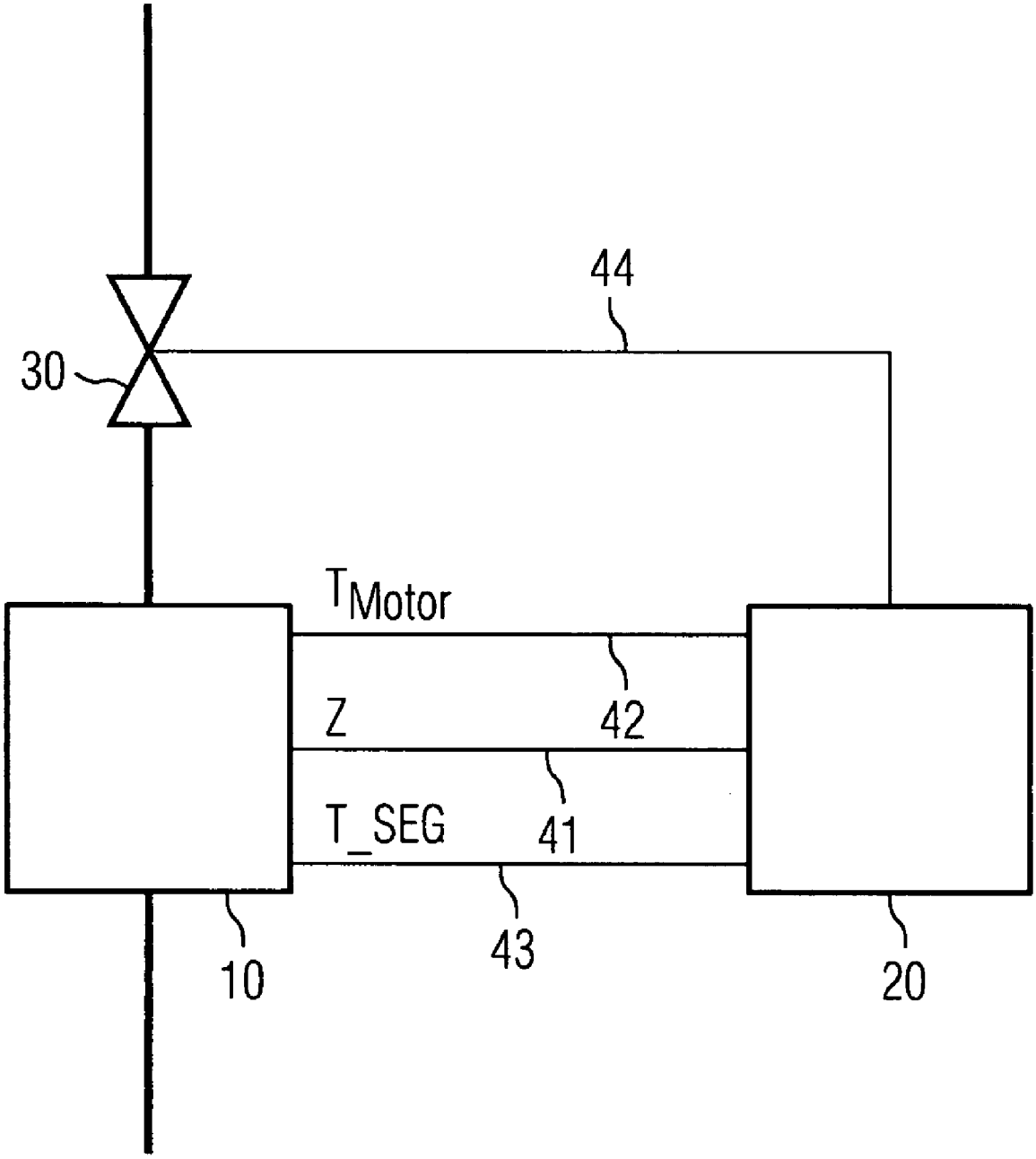
44
30
TMotor
42
Z
41
T_SEG
43
10
20

METHOD FOR CONTROLLING AN INTERNAL COMBUSTION ENGINE IN THE NEUTRAL POSITION

CROSS REFERENCE TO RELATED APPLICATIONS

This application is the US National Stage of International Application No. PCT/EP2005/053869, filed Aug. 5, 2005 and claims the benefit thereof. The International Application claims the benefits of German application No. 10 2004 044 652.0 filed Sep. 15, 2004, both of the applications are incorporated by reference herein in their entirety.

FIELD OF INVENTION

The invention relates to a method for controlling an internal combustion engine in the neutral position.

BACKGROUND OF THE INVENTION

When controlling the internal combustion engine in the neutral position, as fast as possible a response to a deviation in the rotational speed from the desired setpoint value is crucial for the quality of idle running. This is particularly the case if an unknown load is applied, and for start-up.

Not only the measured rotational speed but also the rotational speed gradient calculated therefrom is used for the control. However, the problem with using the rotational speed gradient for control is that the rotational speed gradient—even under stationary conditions—is never really constant. This is because of measuring errors which result from mechanical and electrical tolerances when recording the measured values and fluctuations in synchronism of the internal combustion engine. Hence until now only the filtered rotational speed gradient has been used for control, with short-term fluctuations being filtered out.

SUMMARY OF INVENTION

The object of the invention is hence to deliver an improved method of controlling an internal combustion engine in the neutral position, which should offer quieter running of the internal combustion engine.

To this end, according to the invention a method is proposed which has the following steps:

- measurement of the actual idle rotational speed,
- comparison of the actual idle rotational speed with a desired idle rotational speed,
- determination of a correction torque depending on a rotational speed gradient, if the deviation in the actual idle rotational speed exceeds the desired idle rotational speed by at least a predetermined value,
- addition of the correction torque to the actual engine torque demand of the internal combustion engine.

The invention is based on the knowledge of using the actual idle rotational speed gradient directly to control the idle rotational speed. As a result it is possible to respond to fluctuations faster. This is made possible in that a desired idle rotational speed is first set, with which the actual idle rotational speed is then compared. If both values deviate from one another by at least a certain amount a signal is immediately generated to change the engine torque demand, so that it is possible to response with appropriate speed to fluctuations in the actual rotational speed. The signal to change the engine torque demand depends on the rotational speed gradient, preferably at the time of the deviation. The inventive method thus takes into account the rotational speed gradient if the actual idle rotational speed lies outside a window of tolerance for the desired value for the rotational speed.

A window of tolerance is formed for the desired idle rotational speed, within which corrective action is not taken, the size of the window of tolerance depending on the desired idle rotational speed and/or the coolant temperature and/or the ageing of the engine and/or the engine type and/or tolerances thereof. Thus external influences on the quiet running of the internal combustion engine can be taken into account, so that ultimately a rapid response by the controller is achieved.

The relationship between the correction torque and the actual idle rotational speed gradient can be stored in a characteristic field, so that with knowledge of the actual idle rotational speed the correction torque can very easily be derived from the characteristic field.

Alternatively the correction torque can also be determined by multiplying the negative actual idle rotational speed gradient by the moment of inertia of the internal combustion engine and by a correction factor.

It is further proposed that the correction torque is added only if the actual value of the rotational speed is less than a predefined lower value. This means that the idle rotational speed is corrected only in the case of diminishing rotational speeds, in order to prevent the internal combustion engine from stalling. No action is taken if a maximum idle rotational speed is exceeded, since otherwise there would be a risk of air mass fluctuations arising and an air reserve is built up in a positive manner.

BRIEF DESCRIPTION OF THE DRAWINGS

The invention is explained further below on the basis of an exemplary embodiment.

The single FIGURE shows an internal combustion engine with an evaluation unit and a throttle valve regulator.

DETAILED DESCRIPTION OF INVENTION

The FIGURE shows an internal combustion engine 10, an evaluation unit 20 and a throttle valve 30 in diagrammatic form. The internal combustion engine 10 is connected to the evaluation unit 20 via the signal lines 41, 42 and 43, the evaluation unit 20 in turn being connected to the throttle valve via the signal line 44. Instead of the signal lines 41, 42, 43 and 44 it is also possible to use a bus system, in which the data packets are identified by means of individual coding and thus can be sent sequentially and read again by means of a special decoding. The segment time T_SEG is initially determined in the internal combustion engine 10 using the crankshaft signal. The segment time is the time between two ignition operations of the internal combustion engine, i.e. in a four-stroke engine with four cylinders this time would correspond to the time which the crankshaft needs for half a revolution. The actual rotational speed is derived from this segment time in known fashion.

The actual rotational speed is now determined at regular intervals, whereby the increment can correspond to the segment time. This results in the unfiltered actual idle rotational speed gradient $$N_GRD=(N(n)-N(n-1))/T_SEG.$$

This actual idle rotational speed gradient N_GRD is determined in the evaluation unit 20 from the segment time T_SEG. The window of tolerance and the desired rotational speed can in this case depend on the desired idle rotational speed and/or the coolant temperature and/or the ageing of the engine and/or the engine type and/or tolerances thereof. Thus a normal quiet running of the internal combustion engine is accepted, so that unnecessary intervention in respect of the idle rotational speed is avoided and a stable control behavior is created. To determine the window of tolerance the signals relating to the coolant temperature T_Motor and other characteristic data Z of the engine are sent to the evaluation unit 20. If the evaluation unit 20 now ascertains a deviation in the actual idle rotational speed from the desired idle rotational speed by a predetermined value, a correction torque $M_{korr}$ is read out from a characteristic field, or is calculated using an equation, which can be for example $$M_{korr}=K\times\theta\times(-N_GRD).$$

θ here designates the moment of inertia of the internal combustion engine and K a constant which can be selected individually for each internal combustion engine. When the correction torque $Mk_{korr}$ is known this is added to the engine torque demand of the internal combustion engine and a corresponding signal is sent to the throttle valve 30 via the signal line 44. The air mass flow can then be correspondingly changed via the throttle valve 30, so that the torque of the internal combustion engine is increased and thus the idle rotational speed also rises. However, it is also conceivable for other means to be used to increase the air mass flow, e.g. a bypass controller, compressors, turbochargers, etc.

The invention claimed is:

1. A method for controlling an internal combustion engine in the neutral position, comprising:

measuring an actual idle rotational speed;

comparing the actual idle rotational speed with a desired idle rotational speed;

determining a correction torque based on a gradient of the actual rotational speed, if the actual idle rotational speed deviates from the desired idle rotational speed by at least a predetermined value; and adding the correction torque to an actual engine torque demand of the internal combustion engine.

2. The method as claimed in claim 1, wherein a window of tolerance is assigned to the desired idle rotational speed where the window of tolerance is defined based on factors selected from the group consisting of: the desired idle rotational speed, a coolant temperature, an ageing of the engine, an engine type, a tolerances of the engine, and combinations thereof.

3. The method as claimed in claim 1, wherein the relationship between the correction torque and the actual idle rotational speed gradient is stored in a characteristic field, which is saved in an evaluation unit, the actual idle rotational speed gradient is passed to the evaluation unit and the correction torque is derived from the characteristic field.

4. The method as claimed in claim 1, wherein the correction torque is determined in accordance with the following equation:

$$Mkorr=K\theta(-N_GRD)$$

where K is a constant and .theta. is the moment of inertia of the internal combustion engine.

5. The method as claimed in claim 1, wherein the correction torque is added if the actual idle rotational speed is less than the desired idle rotational speed by the predetermined value.

6. The method as claimed in claim 1, wherein the engine torque is increased by increasing the air mass flow.

7. A method for controlling an internal combustion engine idle operation, comprising:

measuring an actual idle rotational speed of the engine;

comparing the actual idle rotational speed with a desired idle rotational speed;

determining a speed gradient of the actual rotational speed of the engine;

determining a correction torque based on the actual speed gradient of the engine, if the actual idle rotational speed deviates from the desired idle rotational speed by a predetermined value; and adjusting an engine air mass flow to increase an engine torque delivery by the correction torque amount.

8. The method as claimed in claim 7, wherein a window of tolerance is assigned to the desired idle rotational speed where the window of tolerance is defined based on factors selected from the group consisting of: the desired idle rotational speed, a coolant temperature, an ageing of the engine, an engine type, a tolerances of the engine, and combinations thereof.

9. The method as claimed in claim 7, wherein the relationship between the correction torque and the actual idle rotational speed gradient is stored in a characteristic field, which is saved in an evaluation unit, the actual idle rotational speed gradient is passed to the evaluation unit and the correction torque is derived from the characteristic field.

10. The method as claimed in claim 7, wherein the correction torque is determined in accordance with the following equation:

$$Mkorr=K\theta(-N_GRD)$$

where K is a constant and .theta. is the moment of inertia of the internal combustion engine.

11. The method as claimed in claim 7, wherein the correction torque is added if the actual idle rotational speed is less than the desired idle rotational speed by the predetermined value.

* * * * *